US007027042B2

(12) United States Patent
Heo

(10) Patent No.: US 7,027,042 B2
(45) Date of Patent: Apr. 11, 2006

(54) DISPLAY APPARATUS AND ERROR DETECTION METHOD THEREOF

(75) Inventor: Jae-cheol Heo, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 198 days.

(21) Appl. No.: 10/199,054

(22) Filed: Jul. 22, 2002

(65) Prior Publication Data

US 2003/0146884 A1 Aug. 7, 2003

(30) Foreign Application Priority Data

Feb. 5, 2002 (KR) ..... 2002-6492

(51) Int. Cl.
*G09G 3/00* (2006.01)

(52) U.S. Cl. ..... 345/204; 345/212; 345/214

(58) Field of Classification Search ..... 345/99, 345/545–548, 560, 561, 563, 1.2, 98, 204, 345/205, 211–213; 348/714, 715; 382/218, 382/219, 305, 306, 312

See application file for complete search history.

(56) References Cited

U.S. PATENT DOCUMENTS 3,609,698 A * 9/1971 McCormick ..... 714/800
3,969,577 A * 7/1976 Lloyd et al. ..... 348/130
5,686,934 A * 11/1997 Nonoshita et al. ..... 345/99
5,745,105 A 4/1998 Kim
5,812,149 A * 9/1998 Kawasaki et al. ..... 345/98
5,879,374 A * 3/1999 Powers et al. ..... 607/5
5,909,696 A * 6/1999 Reinhardt et al. ..... 711/144
6,289,466 B1 * 9/2001 Bayramoglu et al. ..... 713/310
6,593,975 B1 * 7/2003 Oh ..... 345/211
6,636,635 B1 * 10/2003 Matsugu ..... 382/218
2003/0011719 A1 * 1/2003 Jang ..... 348/790
2003/0030618 A1 * 2/2003 Jones ..... 345/102

FOREIGN PATENT DOCUMENTS

JP 6-110587 4/1994
JP 7-56658 3/1995

(Continued)

OTHER PUBLICATIONS

"Noninterlaced" and "Interlacing", 1998-2004, Computer Hope.□□http://www.computerhope.com/jargon/n/noninter.htm□□http://www.computerhope.com/jargon/i/interlac.htm.*

*Primary Examiner*—Amare Mengistu
(74) *Attorney, Agent, or Firm*—Staas & Halsey LLP

(57) ABSTRACT

A display apparatus includes a first video signal processing part which processes a video signal output from a video card provided in a computer main body and displays a picture thereof, a picture data storing part, and an error detecting part which captures the video signal at predetermined intervals, stores picture data of the video signal in the picture data storing part, compares the stored picture data to each other after elapse of a predetermined period of time, and outputs an error signal to the computer main body in response to the stored picture data being equal to each other. With this configuration, an error of a computer system is detected and an error signal is output to the computer system in response to a changeless video signal being continuously output from a video card of a computer main body.

34 Claims, 6 Drawing Sheets

FOREIGN PATENT DOCUMENTS

| | | |
|---|---|---|
| JP | 7-72818 | 3/1995 |
| JP | 10-3332 | 1/1998 |
| JP | 2000-181430 | 6/2000 |
| JP | 2000-194305 | 7/2000 |
| KR | 10-268717 | 9/1994 |
| KR | 95-20583 | 7/1995 |
| KR | 20-143627 | 1/1999 |
| KR | 1999-3573 | 1/1999 |

* cited by examiner

DISPLAY APPARATUS AND ERROR DETECTION METHOD THEREOF

CROSS-REFERENCE TO RELATED APPLICATIONS

This application claims the benefit of Korean Patent Application No. 2002-6492 filed on Feb. 5, 2002, in the Korean Industrial Property Office, the disclosure of which is incorporated herein by reference.

BACKGROUND OF THE INVENTION

1. Field of the Invention

The present invention relates to a display apparatus which can detect an error of a computer system and turn off the computer system and an error detection method thereof.

2. Description of the Related Art

A display apparatus processes a video signal received from external signal sources, and displays a picture thereon.

FIG. 6 shows a control block diagram of a conventional display apparatus employed in a desktop computer system. The display apparatus comprises a video signal processing part 35 which processes a video signal received from a video card 33 of a computer main body 30 into a digital video signal, a synchronous signal processing part 37 which processes horizontal/vertical synchronous signals, a picture displaying part 38 which displays a picture based on the digital video signal processed by the video processing part 35 thereon, and a micro controller 39 which determines a resolution according to the horizontal/vertical synchronous signals and controls the digital video signal to be appropriately displayed according to the resolution on the video displaying part 38.

The display apparatus may also have a power saving function for reducing power consumption while the desktop computer system is not operated. Thus, the micro controller 39 of the display apparatus 40 determines whether the desktop computer system is in a normal state or a power saving state according to an input of the horizontal/vertical synchronous signals output from the video card 33, and cuts off electric power supplied to each of signal processing parts provided in the display apparatus where the desktop computer system is in the power saving state of not being input with the synchronous signals, thereby reducing the power consumption.

However, where the computer main body 30 which outputs the video signal to the display apparatus 40 becomes abnormal due to some factor, and the video card 33 outputs data remaining in a graphic memory of the video card 33 to the display apparatus, the display apparatus continuously displays a changeless picture. Accordingly, electric power is wastefully consumed. Even more significantly, where a cathode ray tube (CRT) monitor is employed as the display apparatus, if the changeless picture is continuously displayed on the CRT monitor, the CRT monitor may be damaged.

SUMMARY OF THE INVENTION

Accordingly, it is an object of the present invention to provide a display apparatus and an error detection method thereof, which can detect an error of a computer system and output an error signal to the computer system in response to a changeless video signal being continuously output from a video card of a computer main body.

Another object of the present invention is to provide a display apparatus and an error detection method thereof, which can turn itself and the computer system off in response to a changeless video signal being continuously output from the video card due to an abnormality of the computer system.

Additional objects and advantages of the invention will be set forth in part in the description which follows and, in part, will be obvious from the description, or may be learned by practice of the invention.

To achieve the above and other objects of the present invention, there is provided a display apparatus comprising a first video signal processing part which processes a video signal output from a video card provided in a computer main body and displays a picture thereof, a picture data storing part, and an error detecting part which captures the video signal at predetermined intervals, stores picture data of the video signal in the picture data storing part, compares the stored picture data to each other after elapse of a set time, and outputs an error signal to the computer main body in response to the stored picture data being equal to each other.

According to an aspect of the present invention, the error detecting part cuts off electric power supplied to the first video signal processing part in response to the picture data stored in the picture data storing part being equal to each other.

According to another aspect of the present invention, the error detecting part comprises a second video signal processing part which digitizes the video signal, an operation part which calculates a property containing a unit of the picture data and a size thereof, a horizontal/vertical timing information providing part which processes horizontal/vertical synchronous signals of the video signal, and provides timing information of horizontal and vertical lines and resolution information thereof, and a controller which stores the picture data according to the unit in the picture data storing part based on the property, the timing information, and the resolution information.

The unit of the picture data may be a sum of RGB data corresponding to respective horizontal lines which form a frame of the video signal.

The error detecting part can be a micro controller which controls the first video signal processing part.

The error detecting part may display an error message through an on screen display (OSD) in response to the compared picture data being equal to each other.

To achieve the above and other objects of the present invention, there is provided a computer system comprising a computer main body having a power controller which supplies electric power to components of the computer system and a data processing unit having a central processing unit and a video card, and a display apparatus having a first video processing part which processes a video signal output from the video card and displays a picture thereof, a picture data storing part, and an error detecting part which captures the video signal at predetermined intervals, stores picture data of the video signal in the picture data storing part, compares the stored picture data to each other after elapse of a set time, and outputs an error signal to the computer main body in response to the stored picture data being equal to each other, wherein the computer main body cuts off the electric power supplied to at least one component in response to the error signal output from the error detecting part of the display apparatus.

According to yet another aspect of the present invention, the error signal comprises a power-off request (POR) signal input through an interrupt signal input part of the central processing unit, and the error detecting part cuts off the electric power supplied to the first video signal processing part and outputs a power-off signal to the computer main body in response to the changeless picture data being output from the video card after outputting the error signal.

According to still another aspect of the present invention, the error detecting part comprises a second video signal processing part which digitizes the video signal, an operation part which calculates a property containing the sum of the RGB data of the video signal, a horizontal/vertical timing information providing part which processes horizontal/vertical synchronous signals of the video signal, and provides timing information of horizontal and vertical lines and resolution information thereof, and a controller which stores the picture data according to a unit in the picture data storing part based on the property, the timing information, and the resolution information.

The error detecting part may be a micro controller which controls whether the electric power is supplied to the first video signal processing part.

To achieve the above and other objects of the present invention, there is provided an error detection method of a display apparatus having a first video signal processing part which processes a video signal output from a video card provided in a computer main body and displays a picture thereof, the method comprising capturing the video signal at predetermined intervals and storing picture data of the video signal, comparing the stored picture data to each other after elapse of a set time after a storing time, and outputting an error signal to the computer main body in response to the compared picture data being equal to each other.

According to an additional aspect of the present invention, the outputting of the predetermined error signal comprises outputting a power-off request (POR) signal to the computer main body in response to the compared picture data being equal to each other, capturing and storing the picture data of the video signal at the predetermined intervals after the outputting of the POR signal, and comparing the picture data stored before the outputting of the POR signal with the picture data stored after the outputting of the POR signal.

The outputting of the predetermined error signal further comprises cutting off electric power supplied to the first video signal processing part and outputting a power-off signal to the computer main body in response to the picture data stored before the outputting of the POR signal being equal to the picture data stored after the outputting of the POR signal.

According to a further aspect of the present invention, the storing of the picture data comprises recognizing a property containing a data unit of the video signal and a size thereof, and storing the picture data in the data unit based on the property.

The storing of the picture data may further comprise storing a digital sum of the picture data according to respective horizontal lines based on the property.

The error detection method may further include cutting off the electric power supplied to the first video signal processing part in response to the compared picture data being equal to each other.

The error detection method may include producing a warning sound and displaying an error message in response to the compared picture data being equal to each other.

The error detection method may include displaying an error message through an OSD in response to the compared picture data being equal to each other.

To achieve the above and other objects of the present invention, there is provided a method of controlling a computer system comprising a computer main body having a data processing unit which includes a central processing unit and a video card, and a display apparatus which captures a video signal output from the video card at predetermined intervals, stores picture data of the video signal, compares the stored picture data to each other, and outputs an error signal to the computer main body in response to the stored picture data being equal to each other, the method comprising receiving the error signal, and cutting off electric power supplied to at least one component of the computer system in response to the error signal.

The error signal may be a power-off request (POR) signal input through a system management interrupt (SMI) input pin of the central processing unit.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
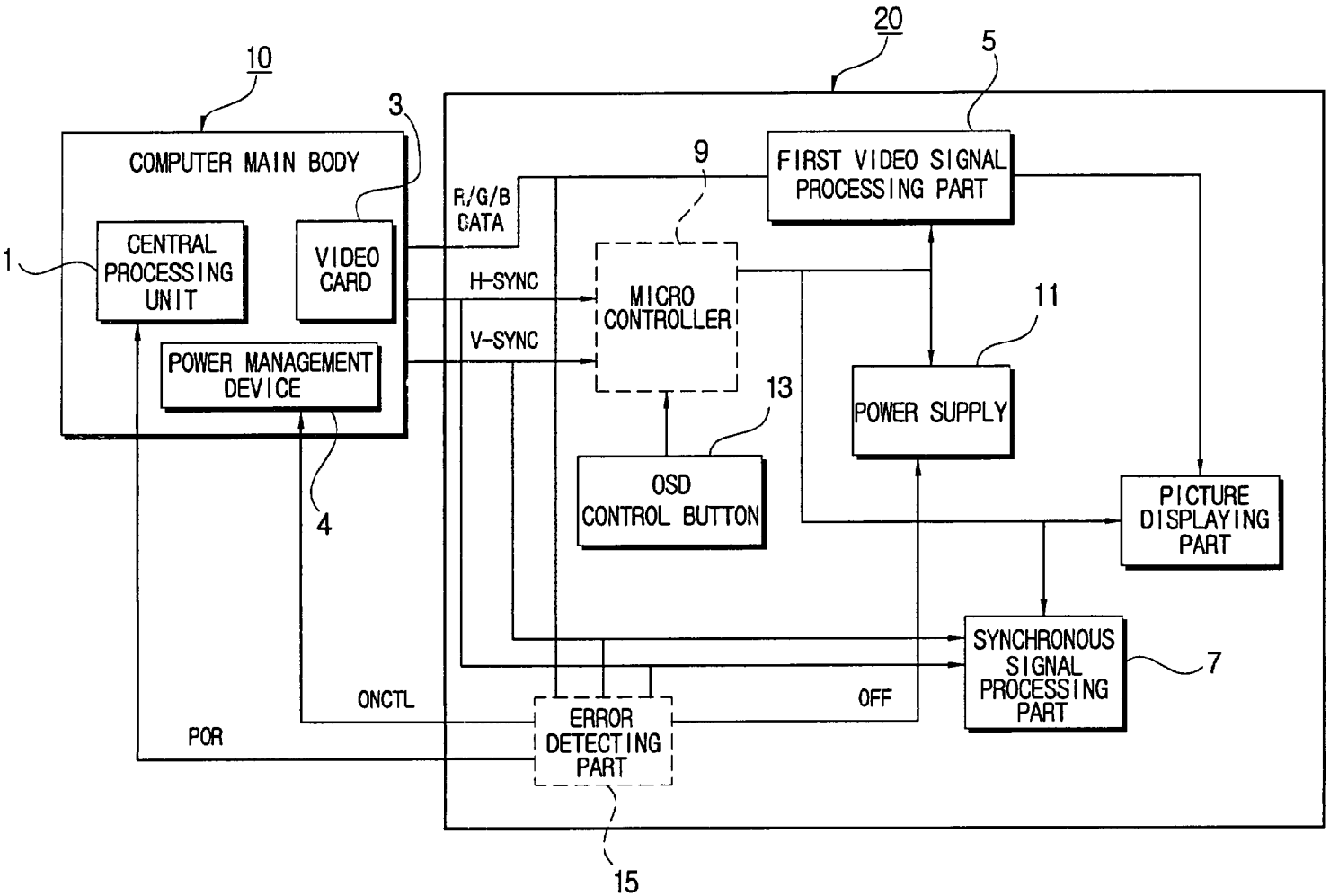
FIG. 1 is a control block diagram of a display apparatus according to an embodiment of the present invention.
Figure 2:
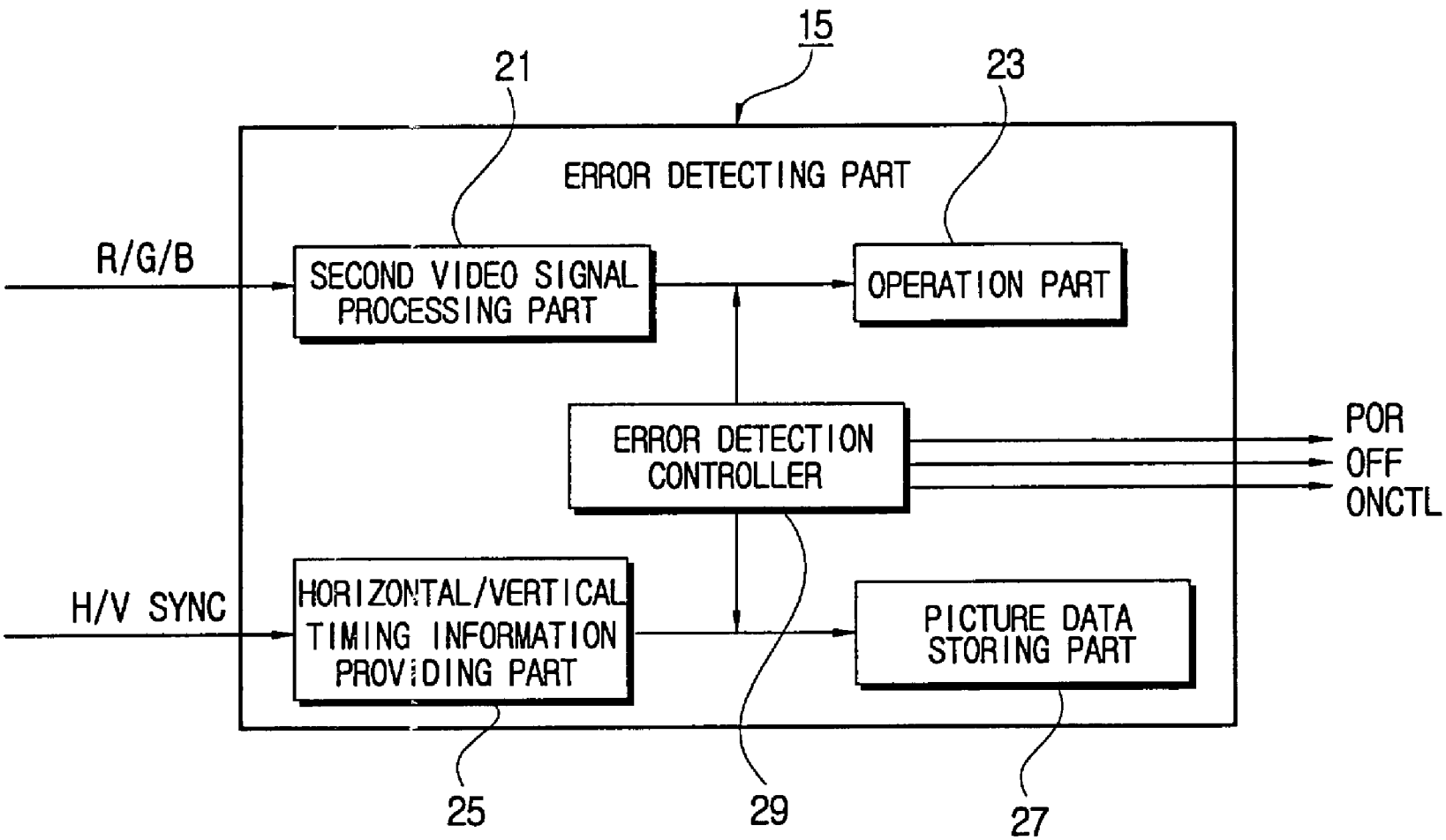
FIG. 2 is a control block diagram of an error detecting part of FIG. 1.

FIG. 1 is a control block diagram of a display apparatus according to an embodiment of the present invention, and FIG. 2 is a control block diagram of an error detecting part of FIG. 1. As shown therein, a display apparatus 20 is connected to a video card 3 of a computer main body ("main body") 10 through a D-sub connector (not shown). The display apparatus 20 comprises a first video signal processing part 5 which processes a video signal received from the video card 3 of the main body 10 into a digital video signal, a synchronous signal processing part 7 which processes horizontal/vertical synchronous signals, a micro controller 9 which determines a resolution according to the horizontal/vertical synchronous signals and controls the digital video signal to be appropriately displayed according to the resolution on a screen, a power supply 11 which supplies electric power to each signal processing part (i.e., 5 and 7) according to a control signal of the micro controller 9, an OSD control button 13 which controls brightness and contrast of the screen, and an error detecting part 15 which stores the video signal in a frame unit after periodically capturing the video signal, and outputs an error signal according to variation of the captured video signal.

As shown in FIG. 2, the error detecting part 15 comprises a second video signal processing part 21 which digitizes the video signal, an operation part 23 which sums pixel data to calculate a property of each horizontal line of the video signal or works an exclusive-OR operation, a horizontal/ vertical timing information providing part 25 which provides information on initial and final timings of respective horizontal lines and respective frames, and on the resolution based on the horizontal/vertical synchronous signals, a picture data storing part 27 which stores picture data of the captured video signal, and an error detection controller 29 which periodically captures the video signal at predetermined intervals (e.g., 5 minutes) according to an operation result of the operation part 23 and stores the picture data of the captured video signal according to the respective horizontal lines which form the frame in the picture data storing part 27.

The error detection controller 29 outputs a power-off request (POR) signal to the main body 10 in response to the stored picture data corresponding to each of the horizontal lines being equal to each other. Thereafter, where the picture data (Red, Green, Blue) of the video signal output from the video card 3 is equal to the picture data stored in the picture data storing part 27, the error detection controller 29 transmits a power-off signal to the power supply 11 of the display apparatus 20 and outputs an on-control (ONCTL) signal to the main body 10 so as to turn off the computer system.

The error detecting part 15 and the main body 10 are connected with a cable in order to transmit the POR and ONCTL signals from the error detection controller 29 to the main body 10.

The error detecting part 15 captures a video signal, and stores the sum of picture data of the captured video signal in the picture data storing part 27 by each horizontal line of a frame unit according to information on a timing of horizontal lines and the frame, and a resolution given by the horizontal/vertical timing information giving part 25. For example, in the case of 1024×768 resolution, each horizontal line includes pixels to the number of 1024, and each pixel comprises picture data (R, G, B). Herein, suppose that a digital value of the picture data (R, G, B) is (1, 1, 1), and the sum of the picture data in one horizontal line is 1024×111=113664. Thus, by applying the above calculation to each horizontal line, the sum of the picture data to the number of 768 per one frame is stored in the picture data storing part 27.

On the other hand, according to the present invention, a central processing unit (CPU) 1 provided in the main body 10 receives the POR signal from the display apparatus 20 through an system management interrupt (SMI) terminal, and gives an interrupt signal to an operating system. Accordingly, as the interrupt signal of the CPU 1 is given to the operating system, where the computer system is in a normal state (at a normal mode or a power saving mode), the operating system controls the video card 3 to output a video signal different from a video signal before receiving the POR signal. However, where the computer system is in an abnormal state, the operating system cannot control the video card 3, wherein the video card 3 outputs a changeless video signal continuously, and allows the error detecting part 15 of the display apparatus 20 to capture and store the changeless video signal.

Herein, the error detecting part 15 outputs the POR signal to the main body 10, and then periodically captures and stores the video signal. Then, after an elapse of a predetermined period of time, the error detecting part 15 compares the sum of picture data before outputting the POR signal with the sum of picture data after outputting the POR signal, and outputs the ONCTL signal to the main body 10 in the case that the sums of picture data are equal to each other.

Generally, the main body 10 is provided with a power management device 4 which controls electric power supplied to the computer system in response to switching on/off of a power switch provided to the outside of the main body 10. According to the present invention, the ONCTL signal output from the error detecting part 15 of the display apparatus 20 is employed as a control signal of the power switch. Therefore, the power management device 4 cuts off the electric power supplied to the computer system in response to the ONCTL signal output from the error detecting part 15, thereby turning off the computer system.

Figure 3:
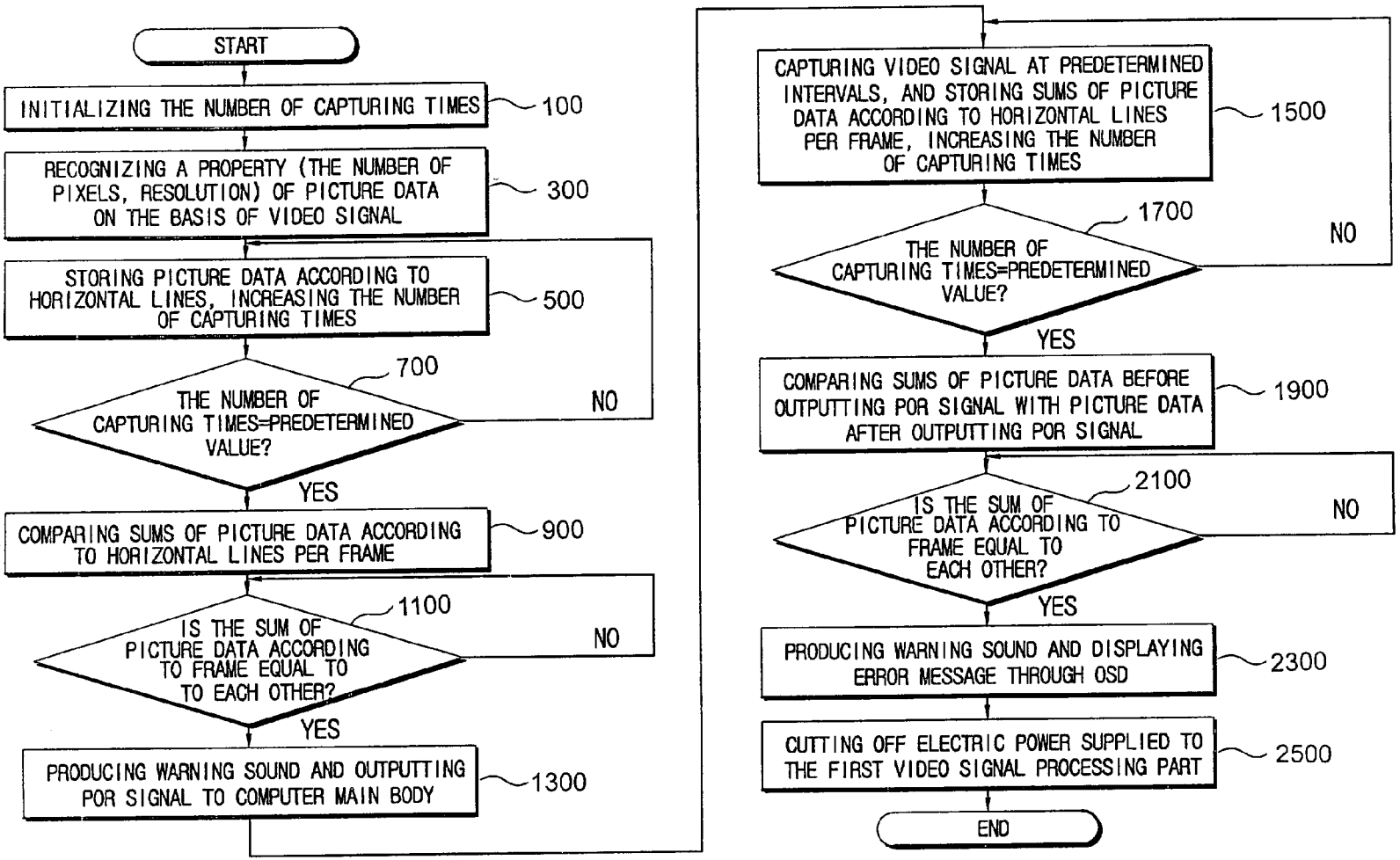
FIG. 3 is a power control flow chart illustrating an error detection method of the display apparatus of FIG. 1.

FIG. 3, with reference to FIGS. 1 and 2, shows a power control flow chart of the display apparatus 20 according to the present invention. As shown therein, a method of capturing a video signal and detecting an error according to picture data of the captured video signal by the error detecting part 15 will be described hereinbelow.

The error detecting part 15 initializes a number of times of capturing the video signal to zero (operation 100), recognizes a property containing a unit of picture data and a size thereof according to the picture data (R, G, B) and horizontal and vertical synchronous signals of the video signal (operation 300), and captures the video signal at predetermined intervals, stores the sum of the picture data according to each horizontal line per frame unit and increases the number of capturing times by one (operation 500). The capturing and storing operations are repeated until the number of capturing times reaches a predetermined value.

For example, where the error detecting part 15 stores the captured video signal according to each horizontal line at 5-minute intervals for an hour, the capturing operation is performed 12-times during that hour. Therefore, where the number of capturing times reaches the predetermined value (e.g., 12-times) after elapse of a predetermined period of time (e.g., an hour) (operation 700), the error detecting part 15 compares the sums of the picture data stored according to each horizontal line per frame unit (operation 900). Where the picture data according to each horizontal line is equal to each other (operation 1100), the error detecting part 15 recognizes the computer system as being in an abnormal state and outputs the POR signal to the main body 10, producing, for example, a warning sound (operation 1300).

After outputting the POR signal, the error detecting part 15 captures and stores the video signal output from the video card 3 for a predetermined number of times (operation 1500). Where the number of capturing times reaches a predetermined value after elapse of a predetermined period of time (operation 1700), the error detecting part 15 compares the sum of the picture data before outputting the POR signal with the sum of picture data after outputting the POR signal (operation 1900). Where the sums of the picture data are equal to each other (operation 2100), the error detecting part 15 cuts off electric power supplied to the first video signal processing part 5 and outputs ONCTL signal to the main body 10 (operation 2500), producing, for example, a warning sound and displaying an error message through an OSD (operation 2300). Herein, the power management device 4 of the main body 10 cuts off the electric power supplied to at least one component of the computer system (operation 2500).

Figure 4:
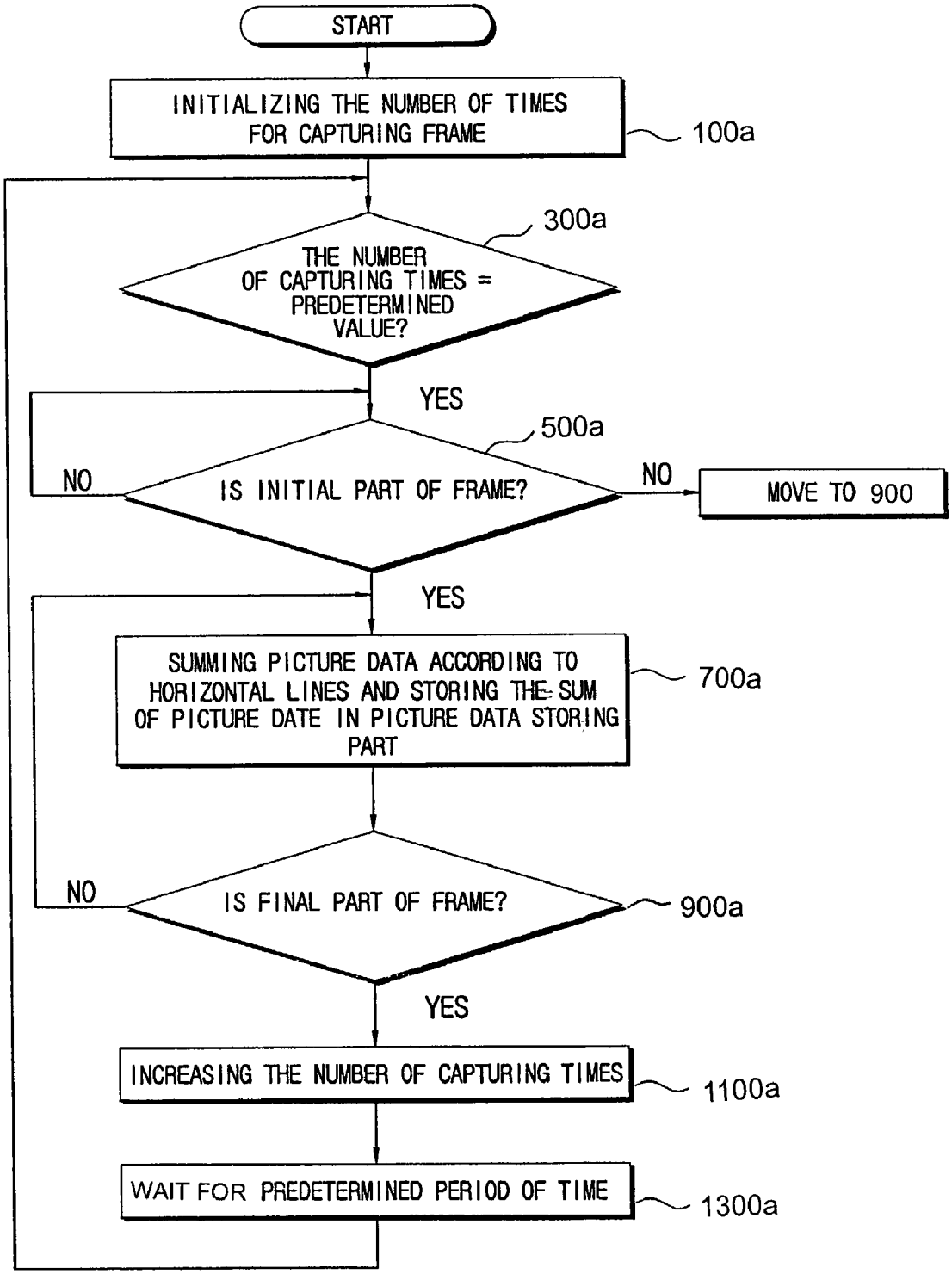
FIG. 4 is a flow chart illustrating a method of capturing a video signal by the error detecting part of FIG. 2.

FIG. 4 shows a flow chart illustrating a method of capturing a video signal by the error detecting part 15 according to the present invention. The error detecting part 15 initializes a number of times of capturing the video signal to zero (operation 100*a*). Then, the error detecting part 15 captures a frame of the video signal until the number of capturing times reaches a predetermined value (operation 300*a*), and detects an initial part of the frame according to a vertical synchronous signal and timing information (operation 500*a*). Where the initial part of the frame is detected, the error detecting part 15 sums picture data of input horizontal lines, and stores the sum of the picture data according to each horizontal line in the picture data storing part 27 (operation 700*a*). Then, in response to a final part of the frame being detected as the last horizontal line is captured (operation 900*a*), the error detecting part 15 increases the number of capturing times of the frame (operation 1100*a*), and captures a video signal of a new frame after elapse of a predetermined period of time (operation 1300*a*). The operations (500*a*) through (1300*a*) are repeated until the number of capturing times reaches the predetermined value.

Figure 5:
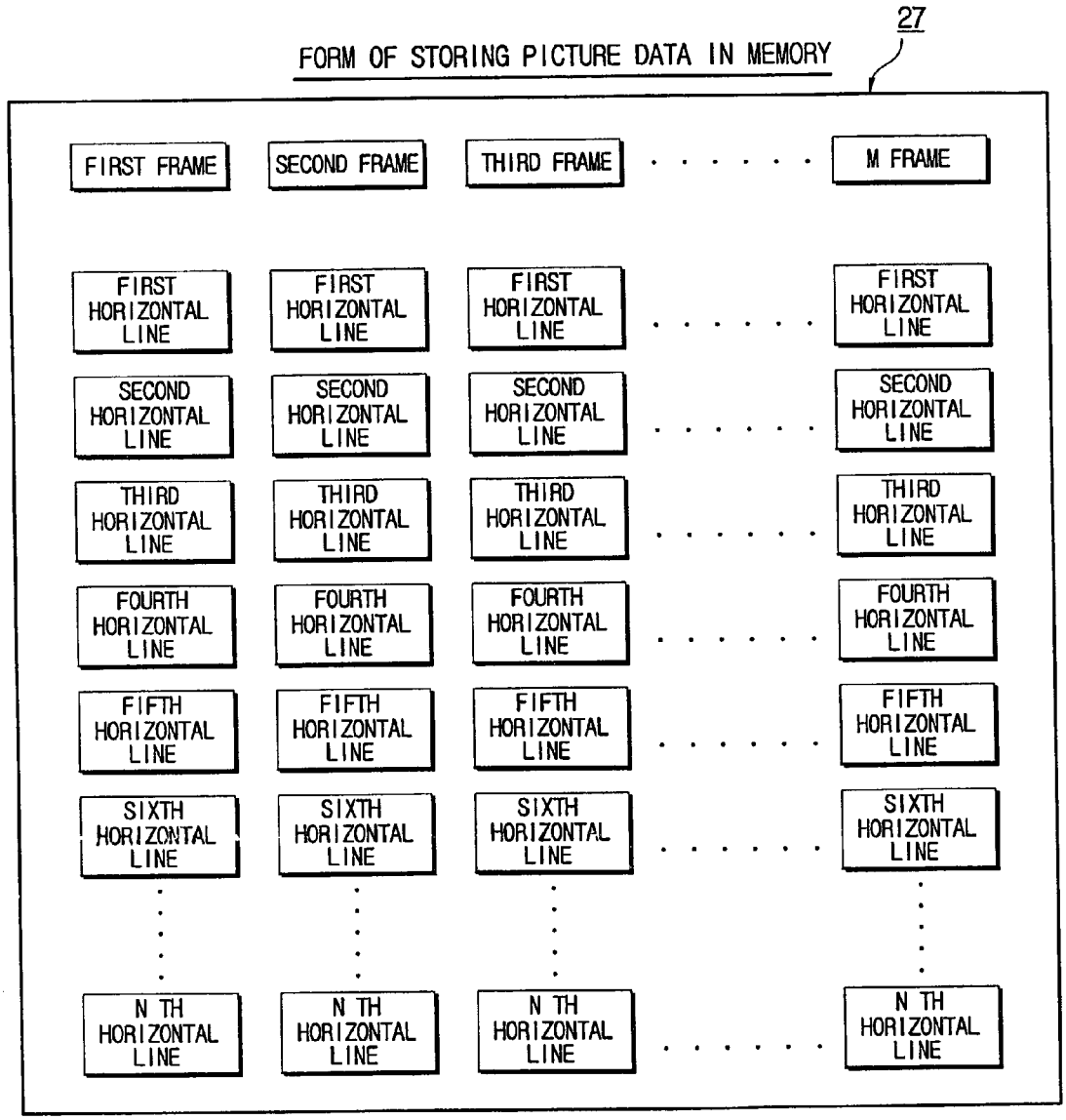
FIG. 5 illustrates a storing form of a picture data storing part of FIG. 2.
Figure 6:
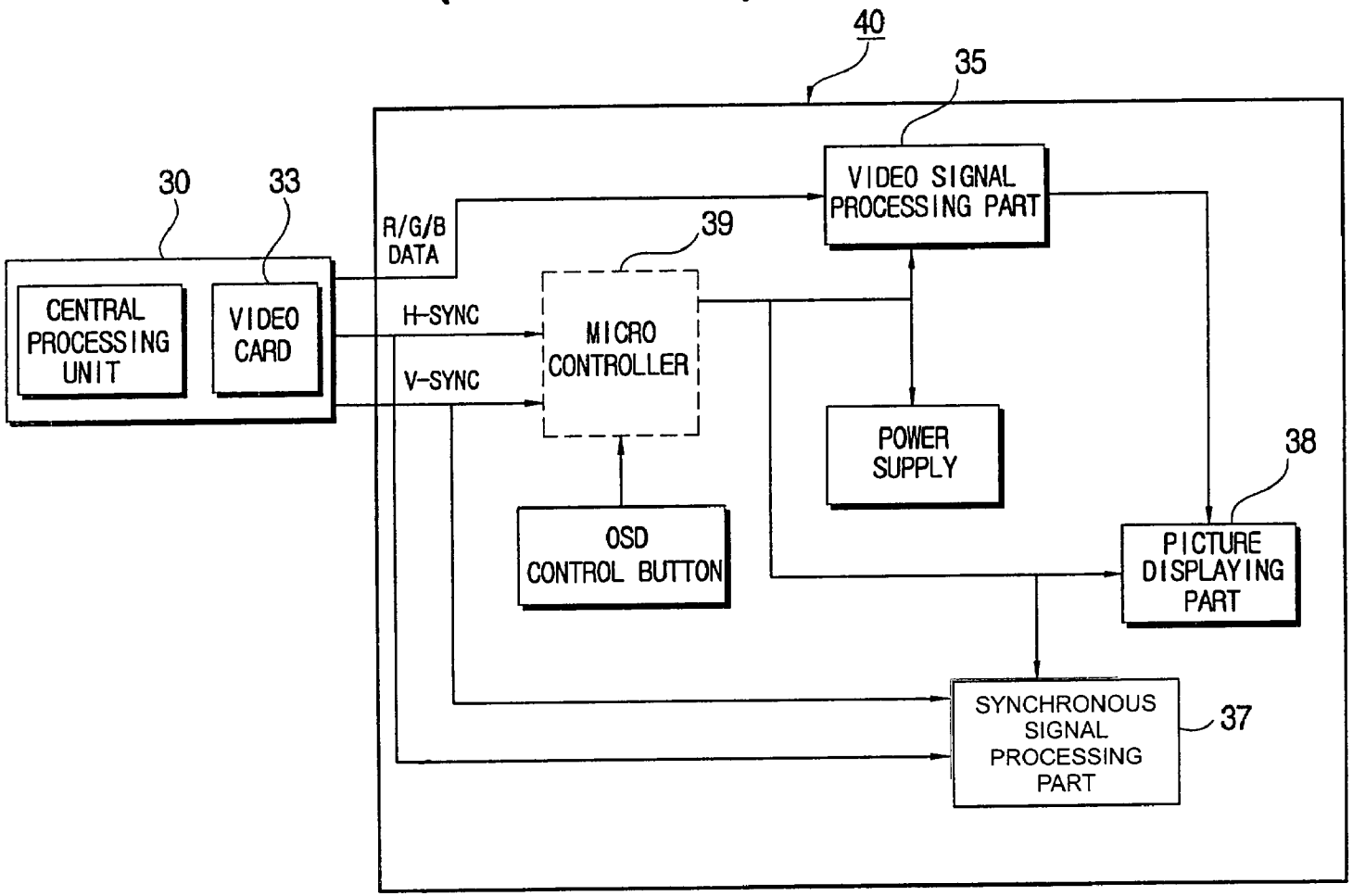
FIG. 6 (PRIOR ART)
FIG. 6 is a control block diagram of a conventional display apparatus.

FIG. 5 illustrates a storing form of the picture data storing part 27 of FIG. 2. As shown therein, a video signal is captured according to a frame, and each sum of picture data corresponding to horizontal lines forming the frame is stored in the picture data storing part 27.

While the error detecting part 15 is described as a hardware component, the error detecting part 15 may be embodied as a software program provided in a micro controller of the display apparatus 20.

In addition, while the sum of the picture data is described to be stored in the frame unit, because a non interlaced scanning type display apparatus was described, the sum of the picture data may be stored in a field unit for an interlaced scanning type display apparatus.

With the above configuration, a video signal is captured and stored at predetermined intervals, and the captured video signals are compared to each other. Where the captured video signals are equal to each other, as a video card of a computer main body outputs a changeless video signal continuously, a computer system is determined as being in an abnormal state, and the display apparatus is turned off by an error signal. Furthermore, the computer system is turned off by a power-off signal.

As described above, the present invention provides a display apparatus and an error detection method thereof, which can detect an error of a computer system and outputs an error signal to the computer system in response to a changeless video signal being continuously output from a video card of a computer main body. Furthermore, the present invention provides a display apparatus and an error detection method thereof, which can turn itself off and the computer system in response to the changeless video signal being continuously output from the video card due to an abnormality of the computer system.

It is understood that a system which uses the present invention may also include permanent or removable storage, such as magnetic and optical discs, RAM, ROM, etc., on which the operation and data structures of the present invention can be stored and distributed. The operations can also be distributed via, for example, downloading over a network such as the Internet.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display apparatus communicating with a video card provided in a computer main body, comprising:

a first video signal processing part which processes a video signal output from the video card provided in the computer main body and displays a picture thereof;

a picture data storing part; and an error detecting part which captures the video signal at predetermined intervals, stores picture data of the video signal in the picture data storing part, compares the stored picture data to each other after elapse of a set time, outputs a first error signal to the computer main body in response to the stored picture data being equal to each other, captures and stores the picture data of the video signal at the predetermined intervals after the outputting of the first error signal, compares the picture data stored before the outputting of the first error signal with the picture data stored after the outputting of the first error signal, and outputs a second error signal to the computer main body in response to the picture data stored before the outputting of the first error signal being equal to the picture data stored after the outputting of the first error signal.

2. The display apparatus according to claim 1, wherein the error detecting part cuts off electric power supplied to the first video signal processing part in response to the picture data stored before the outputting of the first error signal being equal to the picture data stored after the outputting of the first error signal.

3. The display apparatus according to claim 2, wherein the error detecting part comprises:

a second video signal processing part which digitizes the video signal;

an operation part which calculates a property containing a unit of the picture data and a size thereof;

a horizontal/vertical timing information providing part which processes horizontal/vertical synchronous signals of the video signal, and provides timing information of horizontal and vertical lines and resolution information thereof; and a controller which stores the picture data according to the unit in the picture data storing part based on the property, the timing information, and the resolution information.

4. The display apparatus according to claim 3, wherein the unit of the picture data is a sum of RGB data corresponding to the respective horizontal lines which form a frame of the video signal.

5. The display apparatus according to claim 4, wherein the error detecting part produces a warning sound in response to the compared picture data being equal to each other.

6. The display apparatus according to claim 3, wherein the display apparatus is a non-interlaced scanning type display apparatus.

7. The display apparatus according to claim 3, wherein the unit of the picture data is a field unit for an interlaced scanning type display apparatus.

8. The display apparatus according to claim 4, wherein the error detecting part displays an error message through an OSD (on screen display) in response to the compared picture data being equal to each other.

9. The display apparatus according to claim 1, wherein the error detecting part comprises a micro controller which controls the first video signal processing part.

10. The display apparatus according to claim 1, further comprising:

a picture displaying part which displays the picture output from the first video signal processing part;

an OSD (on screen display) control button which controls a brightness and a contrast of the picture displaying part;

a power supply which supplies electric power to the display apparatus; and a synchronous signal processing part which processes horizontal/vertical synchronous signals of the video signal.

11. A computer system comprising:

a computer main body having:

a power controller which supplies electric power to components of the computer system, and a data processing unit having a central processing unit and a video card; and a display apparatus having:

a first video processing part which processes a video signal output from the video card and displays a picture thereof, a picture data storing part, and an error detecting part which captures the video signal at predetermined intervals, stores picture data of the video signal in the picture data storing part, compares the stored picture data to each other after elapse of the set time, outputs a first error signal to the computer main body in response to the stored picture data being equal to each other, captures and stores the picture data of the video signal at the predetermined intervals after outputting of the first error signal, compares the picture data stored before outputting the first error signal with the picture data stored after outputting the first error signal, and outputs a second error signal to the computer main body in response to the picture data stored before outputting, the first error signal being equal to the picture data stored after outputting the first error signal, wherein the computer main body cuts off the electric power supplied to at least one component in response to the second error signal output from the error detecting part of the display apparatus.

12. The computer system according to claim 11, wherein:

the first error signal comprises a POR (power-off request) signal input through an interrupt signal input part of the central processing unit, and the error detecting part cuts off the electric power supplied to the first video signal processing part in response to the picture data stored before the outputting of the first error signal being equal to the picture data stored after the outputting of the first error signal.

13. The computer system according to claim 12, wherein the error detecting part comprises:

a second video signal processing part which digitizes the video signal;

an operation part which calculates a property containing a sum of RGB data of the video signal;

a horizontal/vertical timing information providing part which processes horizontal/vertical synchronous signals of the video signal, and provides timing information of horizontal and vertical lines and resolution information thereof; and a controller which stores the picture data according to a unit in the picture data storing part based on the property, the timing information, and the resolution information.

14. The computer system according to claim 12, wherein the computer main body controls the video card to output another video signal which is different from the video signal in response to receiving the first error signal and the computer main body being in a normal operating state.

15. The computer system according to claim 11, wherein the error detecting part comprises a micro controller which controls whether the electric power is supplied to the first video signal processing part.

16. An error detection method of a display apparatus having a first video signal processing part which processes a video signal output from a video card provided in a computer main body and displays a picture thereof, the method comprising:

capturing the video signal at predetermined intervals;

storing picture data of the video signal;

comparing the stored picture data to each other after elapse of a set time after time of the storing; and outputting a first error signal to the computer main body in response to the compared picture data being equal to each other;

capturing and storing the picture data of the video signal at the predetermined intervals after the outputting of the first error signal;

comparing the picture data stored before outputting the first error signal with the picture data stored after outputting the first error signal; and outputting a second error signal to the computer main body in response to the picture data stored before outputting the first error signal being equal to the picture data stored after outputting the first error signal.

17. The error detection method according to claim 16, further comprising cutting off electric power supplied to the first video signal processing part in response to the picture data stored before the outputting the first error signal being equal to the picture data stored after outputting the first error signal.

18. The error detection method according to claim 17, wherein the storing of the picture data comprises:

recognizing a property containing a data unit of the video signal and a size thereof; and storing the picture data in the data unit based on the property.

19. The error detection method according to claim 18, wherein the storing of the picture data further comprises storing a digital sum of the picture data according to respective horizontal lines based on the property.

20. The error detection method according to claim 16, further comprising cutting off electric power supplied to the first video signal processing part in response to the picture data stored before outputting the first error signal being equal to the picture data stored after outputting the first error signal.

21. The error detection method according to claim 16, further comprising producing a warning sound and displaying an error message in response to the compared picture data being equal to each other.

22. The error detection method according to claim 16, further comprising displaying an error message through an OSD in response to the compared picture data being equal to each other.

23. The error detection method according to claim 16, further comprising:

initializing a number of times of the capturing of the video signal to zero;

increasing the number of times by one in response to the capturing and storing of the video signal; and repeating the capturing and storing of the video signal until the number of times reaches a preset value.

24. The error detection method according to claim 16, wherein the capturing and storing of the picture data of the video signal comprises:

initializing a number of times of the capturing of the video signal to zero;

capturing a frame of the video signal including summing the picture data of horizontal lines of the frame in response to an initial part of the frame being detected;

storing the sum of the picture data according to each horizontal line;

increasing the number of times by one in response to a last part of the frame being detected and the last horizontal line being captured; and capturing and storing another frame of the video after a wait time, until the number of times reaches a preset value.

25. A method of controlling a computer system comprising a computer main body having a data processing unit which includes a central processing unit and a video card, and a display apparatus which captures a video signal output from the video card at predetermined intervals, the method comprising:

storing picture data of the video signal;

comparing the stored picture data to each other after an elapse of a set time after the time of the storing;

outputting a first error signal to the computer main body in response to the compared picture data being equal to each other;

capturing and storing the picture data of the video signal at the predetermined intervals after the outputting of the first error signal;

comparing the picture data stored before the outputting of the the first error signal with the picture data stored after the outputting of the first error signal; and outputting a second error signal to the computer main body in response to the picture data stored before the outputting of the first error signal being equal to the picture data stored after the outputting of the first error signal; and cutting off electric power supplied to at least one component of the computer system in response to the second error signal.

26. The method according to claim 25, wherein the first error signal and the second error signal are input through an SMI (system management interrupt) input pin of the central processing unit.

27. A computer readable medium with operating instructions for implementing a method of detecting an error in a display apparatus which processes a video signal output from a video card provided in a computer main body, performed by a computer, the method comprising:

capturing the video signal at predetermined intervals;

storing picture data of the video signal;

comparing the stored picture data to each other after an elapse of a set time after time of the storing; and outputting a first error signal to the computer main body in response to the compared picture data being equal to each other;

capturing and storing the picture data of the video signal at the predetermined intervals after the outputting of the first error signal;

comparing the picture data stored before the outputting of the first error signal with the picture data stored after the outputting of the first error signal; and outputting a second error signal to the computer main body in response to the picture data stored before the outputting of the first error signal being equal to the picture data stored after the outputting of the first error signal.

28. The computer readable medium according to claim 27, further comprising cutting off electric power supplied to the first video signal processing part in response to the picture data stored before outputting the first error signal being equal to the picture data stored after the outputting the first error signal.

29. The computer readable medium according to claim 28, wherein the storing of the picture data comprises:

recognizing a property containing a data unit of the video signal and a size thereof; and storing the picture data in the data unit based on the property.

30. The computer readable medium according to claim 29, wherein the storing of the picture data further comprises storing a digital sum of the picture data according to respective horizontal lines based on the property.

31. The computer readable medium according to claim 27, further comprising cutting off electric power supplied to the first video signal processing part in response to the picture data stored before the outputting of the first error signal being equal to the picture data stored after the outputting of the first error signal.

32. The computer readable medium according to claim 27, further comprising at least one of producing a warning sound and displaying an error message in response to the compared picture data being equal to each other.

33. The computer readable medium according to claim 27, wherein the capturing and storing of the picture data of the video signal comprises:

initializing a number of times of the capturing of the video signal to zero;

capturing a frame of the video signal including summing the picture data of horizontal lines of the frame in response to an initial part of the frame being detected;

storing the sum of the picture data according to each horizontal line;

increasing the number of times by one in response to a last part of the frame being detected and the last horizontal line being captured; and capturing and storing another frame of the video after a wait time, until the number of times reaches a preset value.

34. A display apparatus communicating with a computer main body, comprising:

a video signal processor to process a video signal received from the computer main body;

a picture data storage to store picture data of the video signal; and an error detector to compare the stored picture data with each other after elapse of a set time, to output a first error signal to the computer main body in response to the stored picture data being equal to each other, to compare picture data stored before the outputting of the first error signal to picture data stored after the outputting of the first error signal, and to output a second error signal to the computer main body in response to the picture data stored before the outputting of the first error signal being equal to the picture data stored after the outputting of the first error signal to confirm a computer main body shutdown.

* * * * *

UNITED STATES PATENT AND TRADEMARK OFFICE

CERTIFICATE OF CORRECTION

PATENT NO. : 7,027,042 B2
APPLICATION NO. : 10/199054
DATED : April 11, 2006
INVENTOR(S) : Jae-cheol Heo It is certified that error appears in the above-identified patent and that said Letters Patent is hereby corrected as shown below:

On Title Page Item (56) References Cited, U. S. Patent Documents, column 2, line 5, delete "B1" after "6,636,635" and insert --B2--
Column 11, line 28, delete "the" second occurrence Signed and Sealed this Nineteenth Day of September, 2006

JON W. DUDAS
*Director of the United States Patent and Trademark Office*